US006318989B1

(12) United States Patent
Bonomo et al.

(10) Patent No.: US 6,318,989 B1
(45) Date of Patent: Nov. 20, 2001

(54) STEAM INJECTION PRESS PLATEN FOR PRESSING FIBROUS MATERIALS

(75) Inventors: Brian Bonomo, Chicago; Pete Walsh, St. Charles; Kelly Seifert, Sugar Grove; Alex Vergara, St. Charles; Michelle Merrell, Naperville, all of IL (US)

(73) Assignee: Masonite Corporation, Chicago, IL (US)

( * ) Notice: Subject to any disclaimer, the term of this patent is extended or adjusted under 35 U.S.C. 154(b) by 0 days.

(21) Appl. No.: 09/103,101

(22) Filed: Jun. 23, 1998

(51) Int. Cl.[7] ..... B27N 3/20

(52) U.S. Cl. ..... 425/405.1; 425/407; 425/446; 100/73; 100/325

(58) Field of Search ..... 425/371, DIG. 37, 425/DIG. 60, DIG. 119, DIG. 246, 406, 407, 446, 405.1, 420; 100/73, 325; 156/497, 499; 264/83

(56) References Cited

U.S. PATENT DOCUMENTS

| | | | | |
|---|---|---|---|---|
| 3,891,738 | | 6/1975 | Shen | 264/101 |
| 4,162,877 | | 7/1979 | Nyberg | 425/84 |
| 4,605,467 | | 8/1986 | Böttger | 156/497 |
| 4,786,351 | * | 11/1988 | Elliott et al. | 425/407 |
| 4,850,849 | | 7/1989 | Hsu | 425/407 |
| 5,078,938 | | 1/1992 | Munk et al. | 264/109 |
| 5,195,428 | | 3/1993 | Gawlitta et al. | 100/73 |
| 5,762,980 | * | 6/1998 | Bielfeldt | 425/371 |

FOREIGN PATENT DOCUMENTS

| | | | |
|---|---|---|---|
| 44 41 017A1 | 5/1996 | (DE) | B27N/3/24 |

OTHER PUBLICATIONS

Hsu, A Practical Steam Pressing Technology for Wood Composites, pp. 69–82.

* cited by examiner

*Primary Examiner*—Nam Nguyen
*Assistant Examiner*—Donald Heckenberg
(74) *Attorney, Agent, or Firm*—Darby & Darby

(57) ABSTRACT

A distribution platen, for use in a fiberboard press, having a molding cavity and including a steam injection conduit providing fluid communication into the molding cavity from a remote supply of steam. The distribution platen further includes steam venting conduit which provides fluid communication from the molding cavity to a remote location. The press platen allows for the continuous flow of steam into the molding cavity through the dedicated steam injection conduit, and the continuous flow of steam and moisture from the molding cavity through the dedicated venting conduits.

27 Claims, 3 Drawing Sheets

STEAM INJECTION PRESS PLATEN FOR PRESSING FIBROUS MATERIALS

FIELD OF THE INVENTION

The present invention relates generally to presses used to press fiberboard, and more particularly, to a press platen used to press a fibrous mat in an efficient and effective manner.

BACKGROUND OF THE INVENTION

Fiberboard (or particle board) products are formed by pressing and heating a mat of resin-coated wood fibers until the resin cures and adheres the wood fibers together, forming a solid wood-like product. Fiberboard is typically manufactured in the form of MDF (Medium Density Fiberboard). MDF has found its place in many industries as a low-cost, functional board alternative to more expensive solid wood. Although MDF may be used in many applications, its relatively low density of fibers (i.e., less than 0.7) is usually not sufficient to support high detail formed by emboss-pressing. To this end, a high-density fiberboard (HDF) must be used.

A conventional press used to compress a high-density fibrous mat and resin (or binder) to a particular molded shape includes two opposing platens which together define a molding cavity. Typically, at least one platen is heated through conduction, such as through the use of electric heating coils or by passing steam through appropriate conduits located in at least one of the platens. Although existing presses have been successful in making fiberboard products using only conduction heat (hot pressing), today's manufacturing demands require faster cycle times on the press and the use of stronger high-temperature resins to produce highly detailed, higher density, and, at times, thicker fiberboard products. A ten fold increase in the speed of curing of the furnish (or fibrous mat) may be realized by introducing steam into the mat. Steam may be introduced to the molding cavity from one platen. The injected steam passes through "channels" or interstitial spaces in the fibrous mat located within the molding cavity and is drawn from the mat by vacuum, or a suitable pressure differential, through appropriate openings and conduits provided in the opposing platen. This known cross-flow method of steam injection transfers the heat of the steam to the furnish forming the fibrous mat by heat-convection which effectively raises the core temperature of the mat quickly and uniformly and allows the resin to cure evenly and quickly.

One such steam-injection fiberboard production press is currently available from Sunds Defibrator, Inc. of Norcross, Ga. The press uses two steam distribution platens; an upper platen injects steam downward into the molding cavity and furnish while the opposing lower platen vents the steam (and any resulting condensation or moisture) from the bottom of the furnish.

Although this existing "cross flow" press design allows steam to heat all areas of the mat evenly and effectively, it precludes the use of an embossing platen wherein one surface of the cavity remains "clean", free of any injection nozzles, meshes, grooves, or openings so that high detail may be embossed on the surface of the pressed furnish.

U.S. Pat. No. 4,162,877, issued to D. W. Nyberg discloses a steam-injection fiberboard pressing system which includes two opposing press platens defining a molding cavity into which a fibrous mat is positioned and pressed to a desired shape. Only a lower platen is a fluid distribution platen which includes conduits and apertures to provide fluid communication between the molding cavity and both an external source of steam and a venting system, separated by controlling valves. The upper platen includes no injection or venting apertures or nozzles.

In operation of the system of U.S. Pat. No. 4,162,877, after a fibrous mat is positioned within the molding cavity, steam from the steam supply is introduced through the conduits and apertures of the lower platen and injected into the pressed fibrous mat located within the molding cavity. After a selected period of time, the control valves are operated to close off the supply of steam and thereafter to open the molding cavity to the venting system. The venting system uses the distribution platen to draw steam and moisture from the molding cavity.

Since the opposing (upper) platen of U.S. Pat. No. 4,162,877 is "clean", it may be used as an embossing platen to impress detail into the pressed fibrous mat, but only if the mat has a density less than 0.7. At any higher mat density, according to the patent, a mesh must be used to help prevent air from becoming trapped in the mat adjacent to the upper platen. Air trapped in the mat prevents proper curing of the resin binder and thus yields imperfections and weaknesses in the final product. Unfortunately, for many embossing-press applications, the density of the fibrous mat is greater than 0.7 and any use of a wire mesh, as taught by U.S. Pat. No. 4,162,877 would preclude the use of an embossing surface plate in the opposing platen.

Another problem with the press-platens disclosed in U.S. Pat. No. 4,162,877 is that they cannot allow for a continuous flow of steam from a remote source, through one platen, passing through a prescribed area of the mat located within the molding cavity, and leaving the mat through the same platen. Since both steam-injection and steam/moisture venting share the same system of conduits, passages and apertures located within the lower press platen of the system of U.S. Pat. No. 4,162,877, this press system must alternate between applying steam into the molding cavity through all the apertures and removing steam (and moisture) from the cavity through all the apertures.

It is an object of the invention to provide a fiberboard embossing press which overcomes the deficiencies of the prior art.

It is another object of the invention to provide such an embossing press which allows steam to flow continuously through a fibrous mat located within a molding cavity of the press and simultaneously to vent steam and moisture from the molding cavity while maintaining an embossing surface within the cavity.

In accordance with a preferred embodiment of the present invention, a distribution platen for use in a fiberboard press has a molding cavity and includes a steam injection conduit providing fluid communication into the molding cavity from a remote supply of steam. The distribution platen further includes a steam venting conduit which provides fluid communication from the molding cavity to a remote location. The press platen allows for the continuous flow of steam into the molding cavity through the dedicated steam injection conduit, and the continuous flow of steam and moisture from the molding cavity through the dedicated venting conduits.

DETAILED DESCRIPTION OF THE PREFERRED EMBODIMENT

Figure 1:
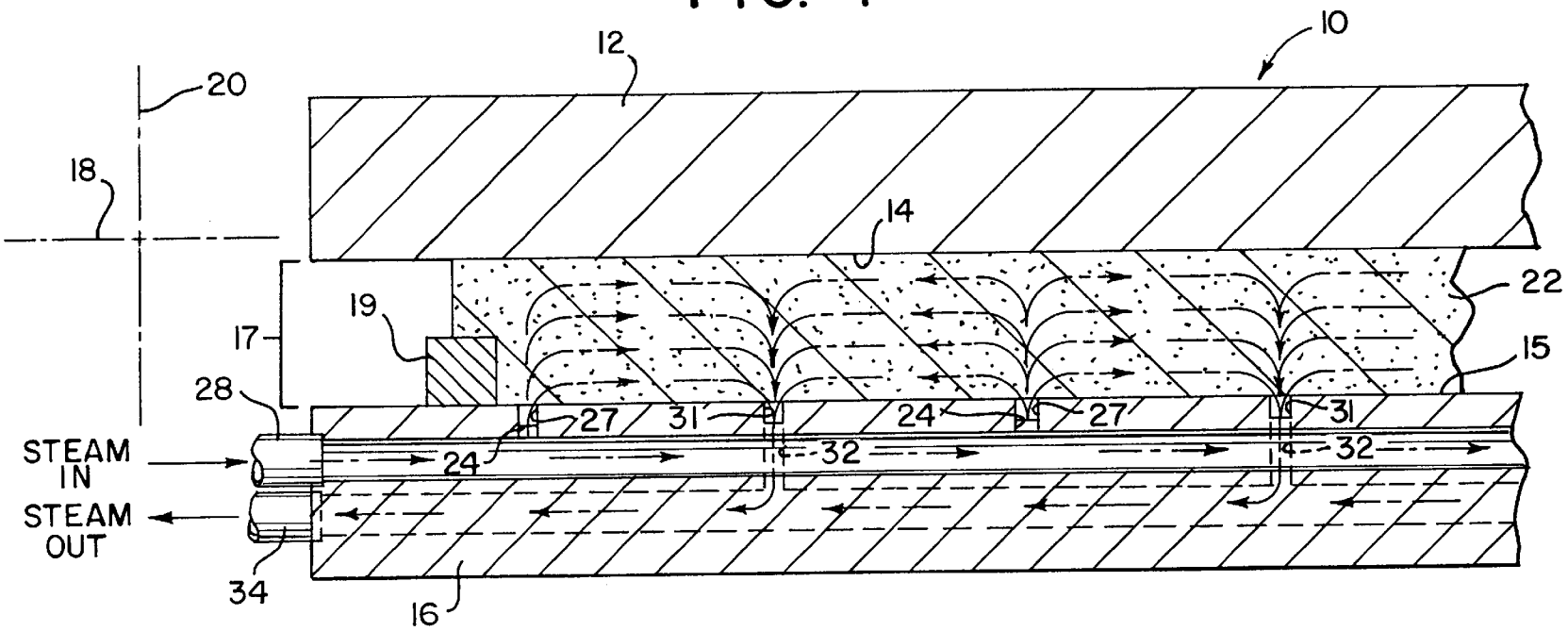
FIG. 1 is a cross sectional view, taken essentially along the line 1—1 of FIG. 2 showing a fiberboard press, according to the invention, including an upper embossing platen, a lower distribution platen, internal distribution conduits, and fluid-flow arrows.

Referring to FIG. 1, a fiberboard press 10 is shown (in part) including an upper embossing platen 12 having an embossing surface 14, and a lower distribution platen 16, and defining a molding cavity 17, a longitudinal axis 18 and a pressing axis 20. As mentioned above, a binder is used to give a compressed fibrous mat or furnish 22 structural integrity and hold it in the newly molded shape. These binders are usually thermosetting resins such as urea-formaldehyde, phenol-formaldehyde, resorcinol-formaldehyde, condensed furfuryl alcohol resins or organic polyioscyanates. The binder is added to the lignocellulosic raw materials or fibers, and the mixture or "furnish" is formed into a fibrous mat which is compressed between the above-described platens of the press while heat (usually in the form of steam) is applied to the mat located within the cavity. Steam is injected throughout furnish 22, either before, during or after, or some combination thereof, compression of the mat, depending on, for example, the furnish and resin type, and the properties desired in the finished product. For an embossed trimboard product, preferably the steam is injected after the mat is fully compressed or consolidated, usually until the binder of furnish 22 is cured. The platens 12, 16 are opened and the molded, cured fiberboard product is removed. As shown in FIG. 1, a perimeter dam 19 may be used, as is known in the art, to minimize edge losses and to otherwise stabilize furnish 22 during pressing.

An important feature of this invention is that embossing surface 14 is "clean" from any ports, nozzles, apertures or other such openings which would likely mar or blemish the surface of the furnish being embossed. The resulting press allows an upper surface of furnish 22 to be embossed with high detail.

Figure 4:
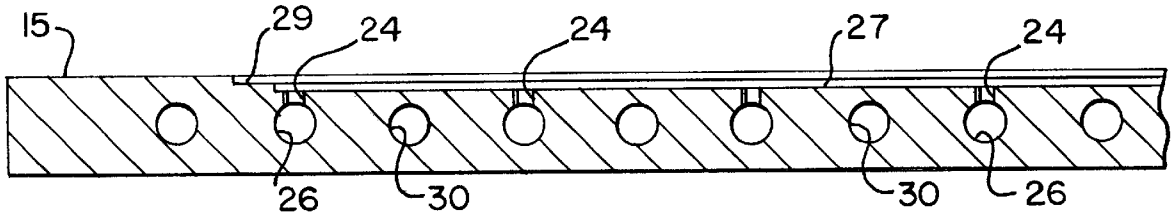
FIG. 4 is a cross sectional view, taken essentially along the line 4—4 of FIG. 3, showing details of injection nozzles, venting ports, supply and venting conduits.

To ensure that all of furnish 22 is evenly and thoroughly cured, as quickly as possible, lower distribution platen 16 is provided with one or more supply conduits 26 to provide steam throughout furnish 22, and one or more venting conduits 30 to simultaneously vent off or remove the steam and any trapped air and/or condensate from furnish 22 in a continuous and free flowing manner. Lower distribution platen 16 has a press surface 15 which includes a plurality of injection nozzles 24, each of which are preferably mounted in an opening 27 that leads to cavity 17, and are aligned along one of several steam supply conduits 26, as shown in FIG. 4. Steam supply conduits 26, according to the example of the present invention shown in FIGS. 1 and 4 are shown oriented along a line substantially parallel to longitudinal axis 18. The steam supply conduits 26 are attached to and in fluid communication with a main steam supply pipe 28.

Located adjacent and substantially parallel to steam supply conduit 26 is a venting conduit 30. Attached to and in fluid communication with the venting conduit 30 is at least one and preferably several venting ports 32. Each venting port 32 provides fluid communication between molding cavity 17 and venting conduit 30 via passage 31 (FIG. 1). Each venting conduit 30 is attached to and in fluid communication with a main venting pipe 34.

The above-described arrangement of conduits, pipes, nozzles, and ports allows a dedicated supply of steam from a remote supply through the main supply pipe 28, steam supply conduits 26, and finally through each injection nozzle 24 and opening 27 so that steam is injected within furnish 22 located within molding cavity 17. As steam is being injected throughout furnish 22, it is also being withdrawn from furnish 22 through venting ports 32, venting conduits 30, and finally through the main venting pipe 34.

Since steam may be applied continuously to furnish 22 and, simultaneously removed continuously from furnish 22, injected steam is forced to flow through furnish 22 in a "cross flow" fashion, without damaging or blemishing the product surface pressed by the embossing surface 14 of upper embossing platen 12.

As shown in FIG. 1, as steam (represented by arrows) is injected through furnish 22 from supply conduit 26 and injection nozzles 24, it flows across and through furnish 22 towards the nearest venting port 32, effectively heating a large area of furnish 22 in the process.

Figure 2:
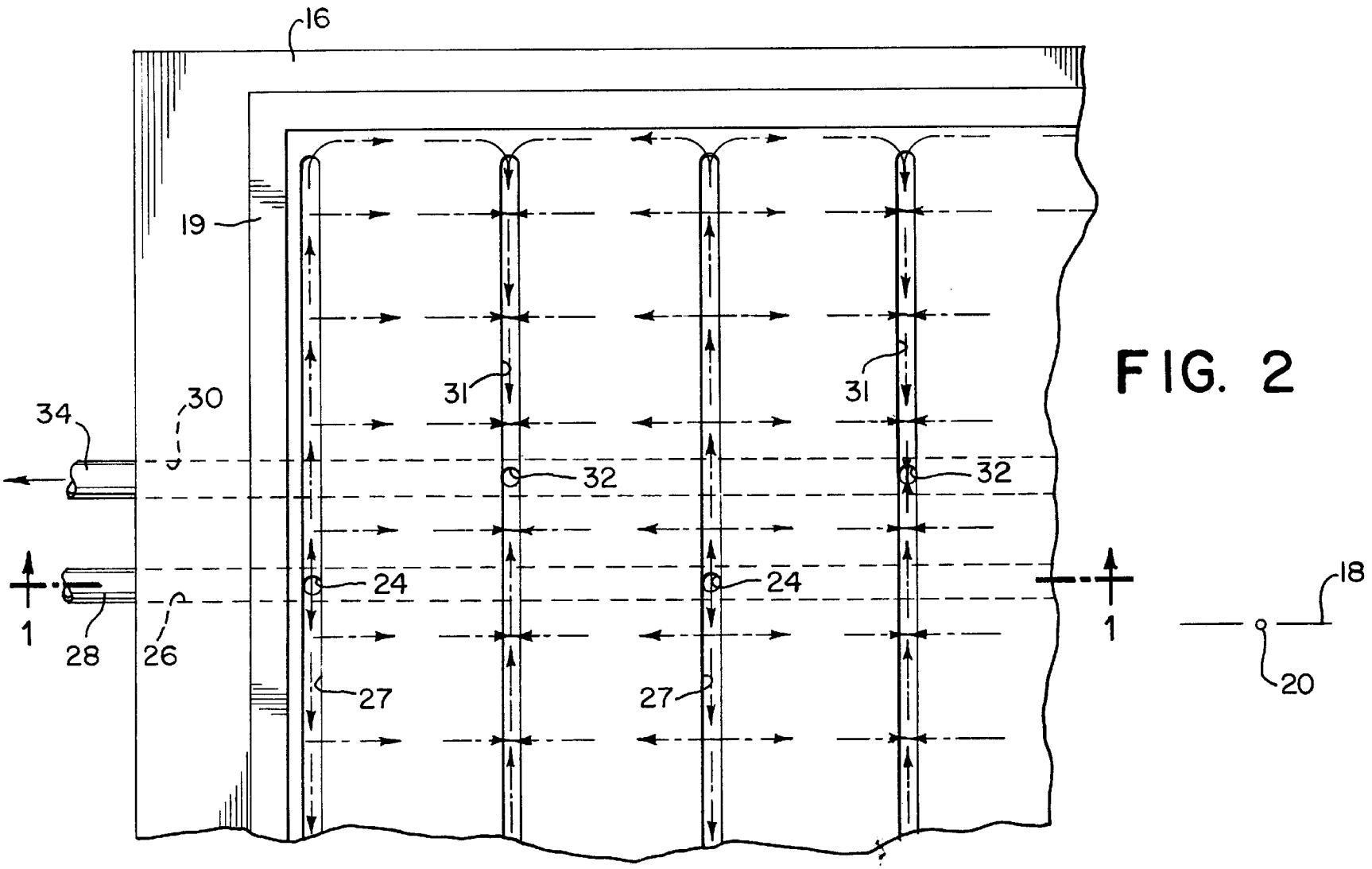
FIG. 2 is a partial plan view, of a distribution platen, according to the invention, showing the flow of steam throughout furnish located between the lower distribution platen surface steam channels.

The embodiment of the distribution platen 16 shown in FIGS. 1 and 2, includes injection nozzles 24 that are staggered with respect to venting ports 32. In an alternate embodiment (not shown), venting ports may be positioned in coordinate alignment with injection nozzles. The exact position and size of each injection nozzle 24 and venting port 32 may be varied according to the specific characteristics of furnish 22, the binder and the dimensions or desired properties of the article being manufactured. For example, injection nozzles 24 located in thicker areas of furnish 22 are preferably sized so that steam injected from these nozzles 24 injects deeper into the thicker furnish 22.

In one illustrative embodiment, plural steam injection nozzles 24 are provided on the press (or contact) surface 15, and are evenly spaced apart from each other and are distributed throughout the press surface. Also, the venting ports 32 may be evenly distributed over the press surface 15, with each steam injection nozzle being located to a corresponding venting port.

To further facilitate distribution of steam to all areas of the mat, press surface 15 of lower distribution platen 16 may also have surface steam distribution channels 27 and surface steam venting channels 31. Each surface steam distribution channel 27 opens to molding cavity 17 and is arranged to be in fluid communication with at least one steam injection nozzle 24. Preferably, a plurality of steam injection nozzles 24 are positioned in the bottom of each surface steam distribution channel. Similarly, each surface steam venting channel 31 opens to molding cavity 17 and is arranged to be in fluid communication with at least one steam venting port 32. Preferably, a plurality of steam venting ports 32 are positioned in the bottom of each surface steam venting channel 31.

Figure 3:
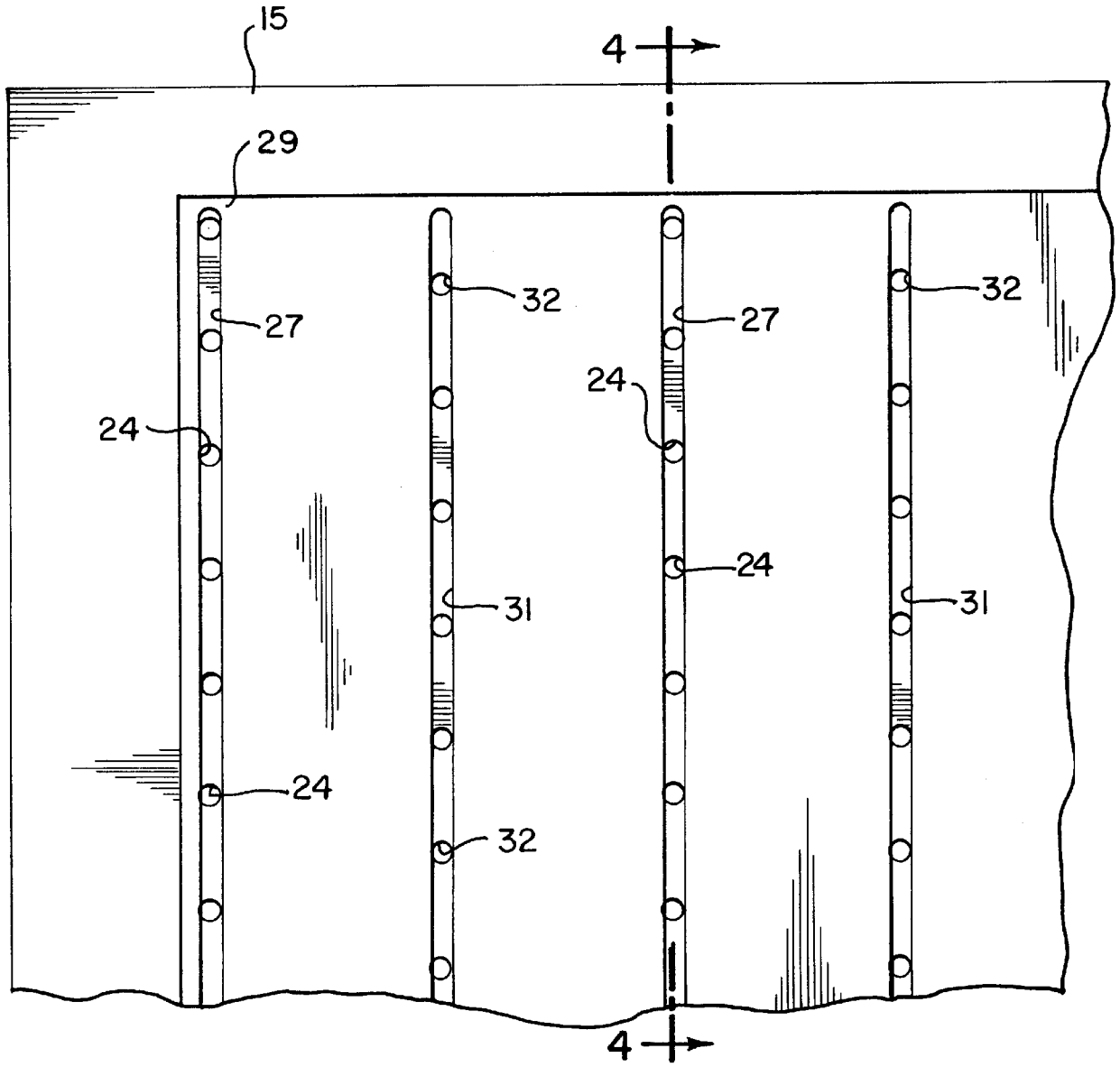
FIG. 3 is a partial plan view, of the distribution platen, according to a second embodiment of the invention, showing details of injection nozzles, venting ports, supply and venting platen surface channels.

In another embodiment shown in FIG. 3 and 4, a recess 29 is provided in the press surface 15 of lower distribution platen 16. The recess 29 is suitably dimensioned to receive a thin slotted plate (not shown) which further facilitates the distribution and venting of steam, and supports the mat over the steam distribution and venting channels, 27 and 31 respectively, and the steam injection nozzles and venting ports, 24 and 32 respectively.

Any appropriate arrangement of conduits and piping may be used to provide steam to steam injection nozzles 24 and vent steam from molding cavity 17, as described above, and in accordance with the invention. Venting conduits 30, and supply conduits 26 may be formed integrally within the lower distribution platen 16 by drilling, or may be supplied through separate and dedicated piping attached remote of lower platen 16.

The above-described steam-injection system including steam injection nozzles 24, surface steam distribution channels 27, steam supply conduits 26 and main steam pipe 28, and the steam venting system including steam venting ports 32, surface steam venting channels 31, steam venting conduits 30, and steam venting pipe 34 do not communicate with each other except through the interstitial spaces or "channels" that exist inside the fibrous mat. The distribution platen, according to the invention allows steam to be injected by the steam injection system, to flow through the "channels" of the furnish or mat, and then to exit through the steam venting system, as described above. This "flow through" action of steam purges the mat of air. Once this is accomplished, both the injection system and the venting system can be used to draw high pressure steam through the mat to speed up the curing process. At the end of the steaming cycle, when the binder has cured, both the injection system and the venting system can be used to vent the pressure within the mold cavity and the mat, i.e., de-pressurize the mold cavity and mat.

Although preferred embodiments of the invention have been disclosed for illustrative purposes, those skilled in the art will appreciate that many additions, modifications and substitutions are possible without departing from the scope and spirit of the invention as defined by the accompanying claims.

What is claimed is:

1. A distribution platen for use in a press for manufacturing fiberboard products from furnish, said distribution platen comprising:

a contact surface for receiving and pressing against said furnish;

at least one steam injection nozzle located at said contact surface and coupled to a source of steam, whereby steam may be injected into said furnish; and at least one steam venting port located at said contact surface and coupled to a source of negative pressure to remove injected steam from said furnish, said steam injection nozzle and steam venting port being simultaneously operable during the operation of said press.

2. The distribution platen according to claim 1, further comprising means located within said distribution platen for fluid communication between said at least one steam injection nozzle and said source of steam.

3. The distribution platen according to claim 1, further comprising means located within said distribution platen for fluid communication between said at least one venting port and said source of negative pressure.

4. The distribution platen according to claim 2, wherein said contact surface includes a plurality of steam injection nozzles that are evenly spaced from each other and distributed throughout said contact surface.

5. The distribution platen according to claim 2, wherein said contact surface includes a plurality of venting ports that arc evenly spaced from each other and distributed throughout said contact surface.

6. The distribution platen according to claim 2, wherein said contact surface includes a plurality of venting ports and a plurality of steam injection nozzles that are evenly spaced from each other and distributed throughout said contact surface, so that each steam injection nozzle lies adjacent to at least one venting port.

7. The distribution platen according to claim 6, wherein the distance between two adjacent steam injection nozzles is approximately equal to the distance between any of said plurality of steam injection nozzles and at least one of said plurality of venting ports so that steam injected into said furnish from any of said plurality of steam injection nozzles is locally vented by an adjacent at least one venting port.

8. The distribution platen according to claim 2, wherein said contact surface includes a plurality of steam injection nozzles which are evenly spaced along each of several steam injection nozzle rows, said steam injection nozzle rows being parallel to each other and disposed across said contact surface.

9. The distribution platen according to claim 8, wherein said contact surface further includes a plurality of venting ports which are evenly disposed along each of several venting port rows, said venting port rows being parallel to each other and to each of said steam injection nozzle rows, said venting ports being disposed across said contact surface, each of said venting port rows being located between two adjacent steam injection nozzle rows.

10. A distribution platen for use in a press for manufacturing fiberboard products from furnish, said distribution platen comprising:

a contact surface for receiving and pressing against said furnish;

at least one steam injection nozzle located at said contact surface and coupled to a source of steam, whereby steam may be injected into said furnish; and at least one steam venting port located at said contact surface and coupled to the atmosphere to remove injected steam from said furnish, said steam injection nozzle and steam venting port being simultaneously operable during the operation of said press.

11. The distribution platen according to claim 10, further comprising means for fluid communication between said at least one steam injection nozzle and said source of steam.

12. The distribution platen according to claim 10, wherein said contact surface comprises means for fluid communication between said at least one venting port and said atmosphere.

13. The distribution platen according to claim 11, wherein said contact surface includes a plurality of steam injection nozzles that are evenly spaced from each other and distributed throughout said contact surface.

14. The distribution platen according to claim 11, wherein said contact surface includes a plurality of venting ports that are evenly spaced from each other and distributed throughout said contact surface.

15. The distribution platen according to claim 11, wherein said contact surface includes a plurality of venting ports and a plurality of steam injection nozzles that are evenly spaced from each other and distributed throughout said contact surface, so that each steam injection nozzle lies adjacent to at least one venting port.

16. The distribution platen according to claim 15, wherein the distance between two adjacent steam injection nozzles is approximately equal to the distance between any of said plurality of steam injection nozzles and at least one of said plurality of venting ports so that steam emitted from any of said plurality of steam injection nozzles is locally vented by an adjacent at least one venting port.

17. The distribution platen according to claim 11, wherein said contact surface includes a plurality of steam injection nozzles which are evenly spaced along each of several steam injection nozzle rows, said steam injection nozzle rows being parallel to each other and evenly spaced across said contact surface.

18. The distribution platen according to claim 17, wherein said contact surface further includes a plurality of venting ports which are evenly disposed along each of several venting port rows, said venting port rows being parallel to each other and to each of said steam injection nozzle rows and evenly spaced across said contact surface, each of said venting port rows being located between two adjacent steam injection nozzle rows.

19. The distribution platen according to claim 11, wherein said fluid communication means between said at least one steam injection nozzle and said source of steam includes at least one integrally formed steam passage, said steam passage connects with each of said at least one steam injection nozzle and said source of steam so that steam may selectively travel from said source of steam, through said steam passage and to said at least one steam injection nozzle to be distributed through said furnish.

20. The distribution platen according to claim 12, wherein said fluid communication means between said at least one venting port and the atmosphere includes at least one integrally formed venting passage, said venting passage connects with each of said at least one venting port and said atmosphere so that water vapor located within said furnish may selectively travel from said venting ports to said atmosphere through said at least one venting passage.

21. The distribution platen according to claim 2, wherein said fluid communication means between said at least one steam injection nozzle and said source of steam includes at least one integrally formed steam passage, said steam passage connects with each of said at least one steam injection nozzle and said source of steam so that steam may selectively travel from said source of steam, through said steam passage and to said at least one steam injection nozzle to be distributed through said furnish.

22. The distribution platen according to claim 3, wherein said fluid communication means between said at least one venting port and said source of negative pressure includes at least one integrally formed venting passage, said venting passage connects with each of said at least one venting port and said source of negative pressure so that water vapor located within said furnish may be drawn through said venting ports to said source of negative pressure through said at least one venting passage.

23. The distribution platen according to claim 9, wherein each of said steam injection nozzle rows and venting rows are parallel to each other.

24. A distribution platen for use in a press for manufacturing fiberboard products from furnish, said distribution platen comprising:

a generally steam-impermeable contact surface for receiving and pressing against said furnish;

at least one steam injection nozzle located at said contact surface and coupled to a source of steam, whereby steam may be injected into said furnish; and at least one steam venting port located at said contact surface and coupled to one of a source of negative pressure and the atmosphere to remove injected steam from said furnish, said steam injection nozzle and steam venting port being simultaneously operable during the operation of said press.

25. The distribution platen according to claim 24, wherein said contact surface is generally smooth in areas not having steam injection nozzles or steam venting ports.

26. The distribution platen according to claim 24, wherein steam is injected a substantial distance into the furnish.

27. The distribution platen according to claim 24, wherein steam is injected substantially throughout the furnish.

* * * * *